US007125285B2

(12) United States Patent
Maejima et al.

(10) Patent No.: US 7,125,285 B2
(45) Date of Patent: Oct. 24, 2006

(54) JOINT CONNECTOR

(75) Inventors: Toshiro Maejima, Haibara-gun (JP); Shigeo Ishizuka, Toyota (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/994,338

(22) Filed: Nov. 23, 2004

(65) Prior Publication Data

US 2005/0142905 A1 Jun. 30, 2005

(30) Foreign Application Priority Data

Nov. 27, 2003 (JP) ..... P2003-396452

(51) Int. Cl.
*H01R 13/648* (2006.01)

(52) U.S. Cl. ..... 439/607

(58) Field of Classification Search ..... 439/607, 439/567, 572, 381, 79–82, 936, 76.1, 579, 439/497, 578, 495, 596; 174/50
See application file for complete search history.

(56) References Cited

U.S. PATENT DOCUMENTS

| | | | | |
|---|---|---|---|---|
| 3,629,787 | A * | 12/1971 | Wilson | 439/67 |
| 5,741,148 | A * | 4/1998 | Biernath | 439/284 |
| 6,132,247 | A * | 10/2000 | Liou et al. | 439/567 |
| 6,249,412 | B1 * | 6/2001 | Caffrey | 361/93.1 |
| 6,273,753 | B1 * | 8/2001 | Ko | 439/579 |
| 6,661,084 | B1 * | 12/2003 | Peterson et al. | 257/680 |
| 6,870,096 | B1 * | 3/2005 | Suzuki et al. | 174/50 |
| 6,926,561 | B1 * | 8/2005 | Handforth et al. | 439/632 |

FOREIGN PATENT DOCUMENTS

| | | | |
|---|---|---|---|
| DE | 74 22 768 | U | 7/1974 |
| EP | 1 033 787 | A1 | 9/2000 |
| JP | 61-142381 | U | 9/1986 |
| JP | 2-216775 | A | 8/1990 |
| JP | 5-15035 | A | 1/1993 |
| JP | 7-95716 | A | 4/1995 |
| JP | 7-192799 | A | 7/1995 |
| JP | 9-46858 | A | 2/1997 |
| JP | 2001-229989 | A | 8/2001 |
| JP | 2001-307816 | A | 11/2001 |

* cited by examiner

*Primary Examiner*—J. F. Duverne
(74) *Attorney, Agent, or Firm*—Sughrue Mion, PLLC

(57) ABSTRACT

A joint connector includes an insulative connector housing, a plurality of connection terminals provided on the connector housing, and a board having a conductive wire. The connection terminals contact to the conductive wire for electrically connecting predetermined connection terminals of the connection terminals each other.

12 Claims, 7 Drawing Sheets

JOINT CONNECTOR

BACKGROUND OF THE INVENTION

This invention relates to a joint connector for connecting a plurality of connection terminals together which are provided, for example, within a mating connector housing.

A joint connector of this kind is used for obtaining a plurality of branch wire portions from a trunk wire portion of a wire harness employed, for example, in an electric system of an automobile or the like, and generally, a technique as disclosed for example in JP-A-8-17531 is known. Namely, as shown in FIG. 6, a joint connector 1 of JP-A-8-17531 includes a connector housing 2, a pair of connection terminals 3 for being fixed to the connector housing 2, and an inter-terminal connecting portion 4 electrically connecting the connection terminals 3 together. The inter-terminal connecting portion 4 is formed by a bus bar, and is adapted to be inserted in a rear side of the connector housing 2.

In the joint connector using such a plug-in type bus bar as the inter-terminal connecting portion, when the number of connection terminals increases, the structure of a portion for effecting the connection between the terminals becomes complicated, and therefore there is used a joint technique (see, for example, JP-A-5-3619) employing bus bars and a board as commonly known in an electric connection box for mounting on an automobile. Namely, the structure as indicated by a circle C in FIG. 7 is used as the portion for effecting the connection between the terminals of the joint connector.

When the number of connection terminals of the joint connector increases, the structure of the portion for effecting the connection between the terminals becomes complicated as described above, and therefore the kinds of bus bars to be used increase, and this invites problems that the management of the parts is complicated and that the weight, the cost and the time and labor for the operation increase. And besides, when the structure as indicated by circle C in FIG. 7 is used, the depth of the joint connector increases, thus inviting a problem that the overall size becomes large. Furthermore, when the structure as indicated by circle C in FIG. 7 is used, the degree of freedom of a circuitry design is limited, so that there is encountered a problem that such a structure can not meet a more complicated circuit arrangement.

SUMMARY OF THE INVENTION

This invention has been made in view of the above circumstances, and an object of the invention is to provide a joint connector which can be formed into a compact, lightweight and low-cost design, and can be enhanced in the degree of freedom of a circuitry design, and can be easily assembled.

In order to achieve the above object, according to the present invention, there is provided a joint connector, comprising:

an insulative connector housing;

a plurality of connection terminals, provided on the connector housing; and a board, on which a conductive wire is formed, wherein the connection terminals contact to the conductive wire for electrically connecting predetermined connection terminals of the connection terminals each other.

Preferably, the board is a multi-layer board having a plurality of board portions which are laminated to each other. A plurality of the conductive wires are respectively formed on the board portions. The connection terminals contact to the conductive wire formed on a predetermined board portion of the board portions.

Preferably, the board is a single-layer board having a front face and rear face. A plurality of the conductive wires are respectively formed on the front and rear faces of the single-layer board. The connection terminals contact to the conductive wire formed on at least one of the front and rear faces of the single-layer board.

Preferably, a circuit, which is connected to the conductive wire, is formed on the board.

Preferably, the connector housing has a mating terminal portion for mating with another terminal to be electrically connected to the connection terminals.

In the above configurations, the plurality of connection terminals are fixed to the connector housing, and press-fit portions of the plurality of connection terminals are inserted in the multi-layer board or the single-layer board. As a result, the joint connector of the invention is formed. In the joint connector of the invention, either the multi-layer board or the single-layer board is used, and the multi-layer board is formed by laminating the board portions (each having the circuit formed thereon by printing), that is, the printed circuit boards, together. On the other hand, the single-layer board includes a single double-sided printed circuit board having the circuits formed on the front and rear sides thereof by printing. The press-fit portion of the connection terminal, when inserted into the multi-layer board or the single-layer board, is resiliently deformed to be kept in a press-fitted condition. When the press-fit portions contact the board, and are electrically connected to the corresponding circuits, the desired connection terminals are electrically connected together. This connection is effected collectively.

Preferably, the joint connector further comprises a cover, fitted to the connector housing to cover the board.

In the above configuration, when the cover is fitted to the connector housing, the multi-layer board or the single-layer board in which the plurality of connection terminals are inserted is protected by the cover. And besides, the multi-layer board or the single-layer board is held by the cover, and is prevented from dropping.

In the above configurations, the joint connector employs the connection terminals each having the press-fit portion, the board (i.e., the printed circuit board) having the circuits formed thereon by printing, and the plurality of connection terminals, fixed to the connector housing, are electrically connected to the corresponding circuits of the printed circuit board, so that the desired connection terminals are collectively electrically connected together. Therefore, there are achieved advantages that this joint connector can be formed into a more compact, lightweight and lower-cost design as compared with the related structure employing bus bars, and that the degree of freedom of the circuitry design can be enhanced, and the assembling operation can be effected easily.

Further, in the above configurations, the cover is fitted to the connector housing, and therefore there are achieved advantages that the multi-layer board or the single board is protected by the cover, and also is held by the cover against dropping and that the assembling operation can be effected easily.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

The invention will now be described with reference to the drawings.

Figure 1:
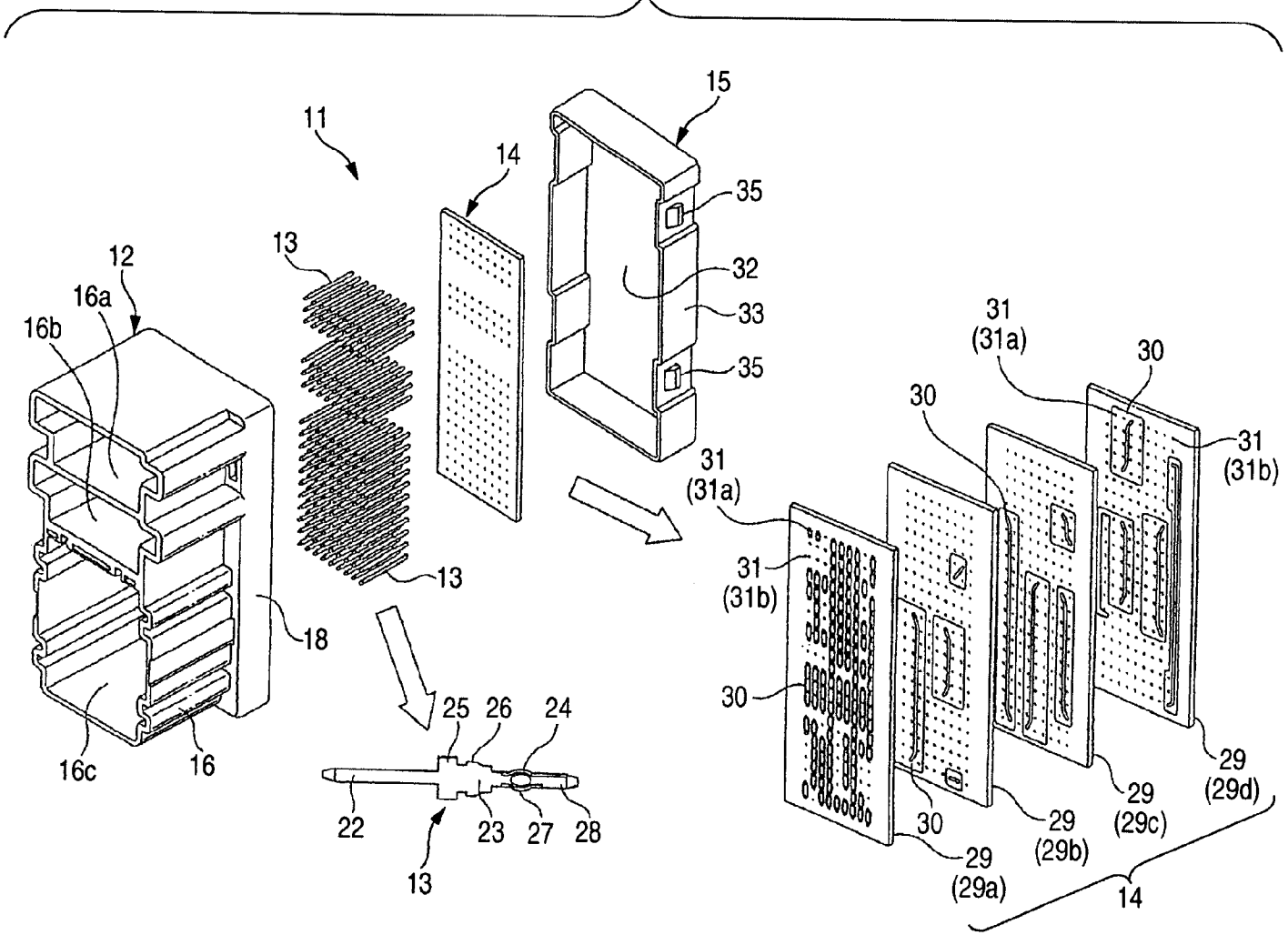
FIG. 1 is an exploded, perspective view of one preferred embodiment of a joint connector of the present invention.
Figure 2:
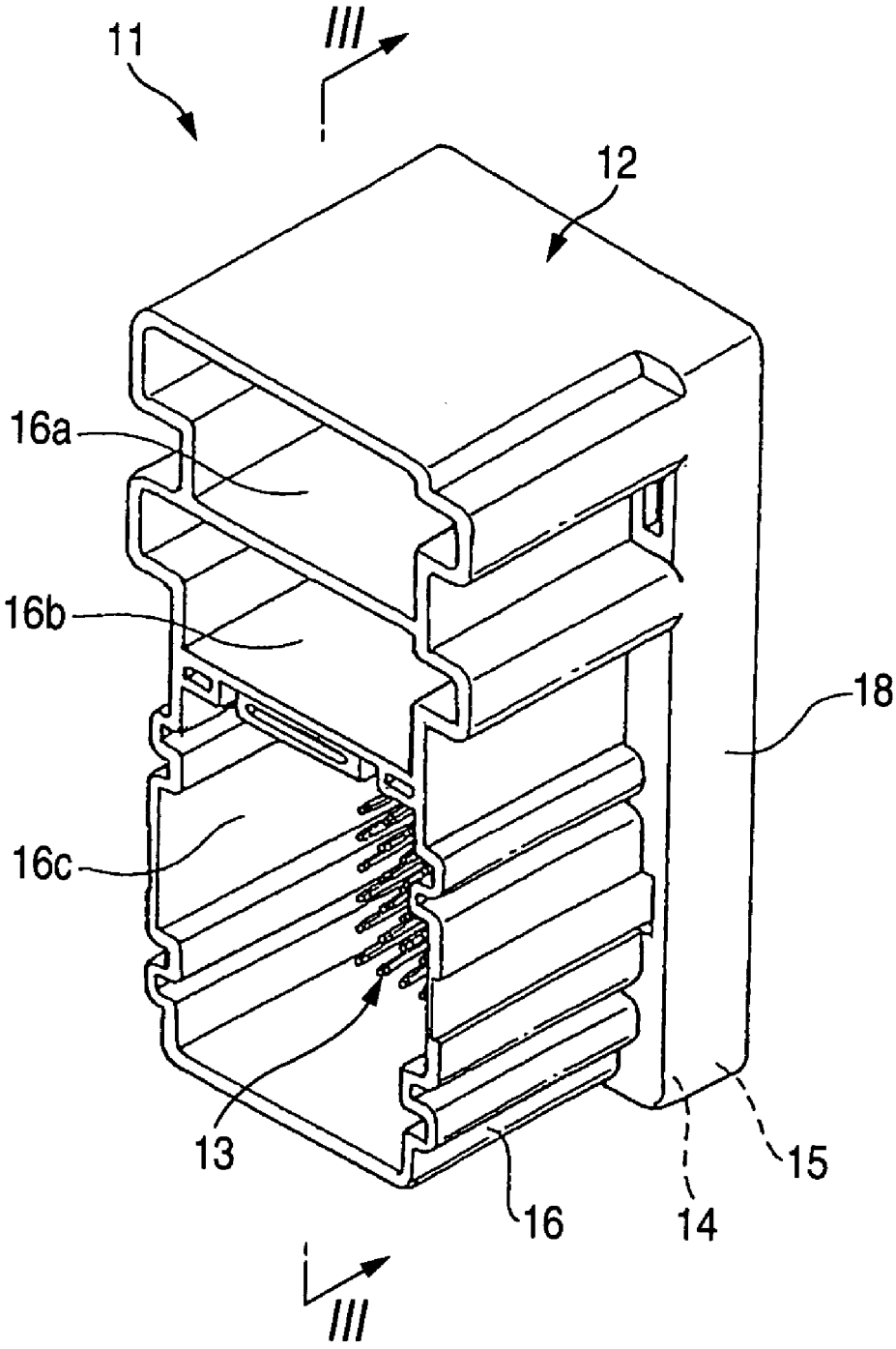
FIG. 2 is a perspective view of the joint connector of the invention.
Figure 3:
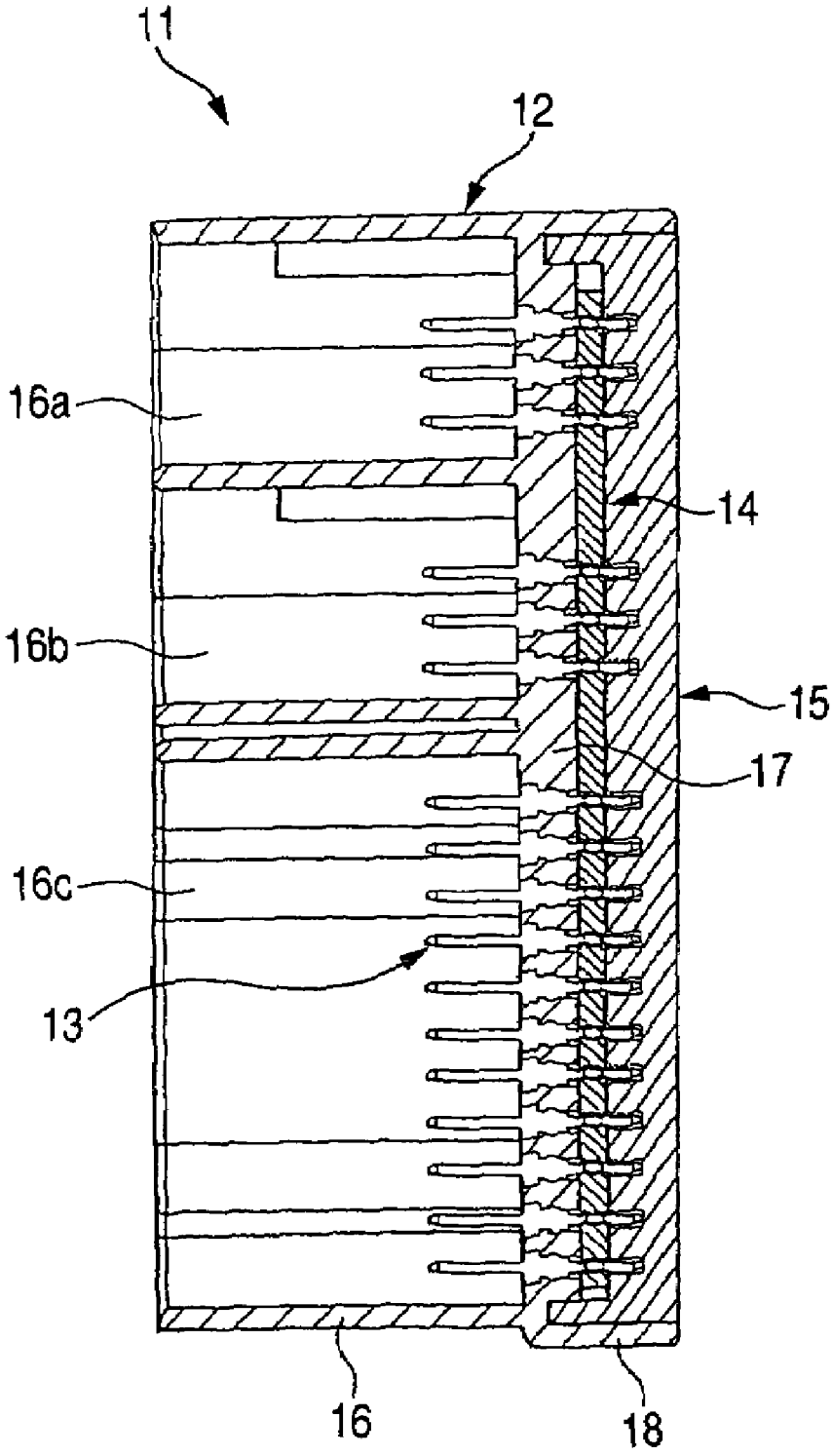
FIG. 3 is a cross-sectional view taken along the line III—III of FIG. 2.
Figure 4:
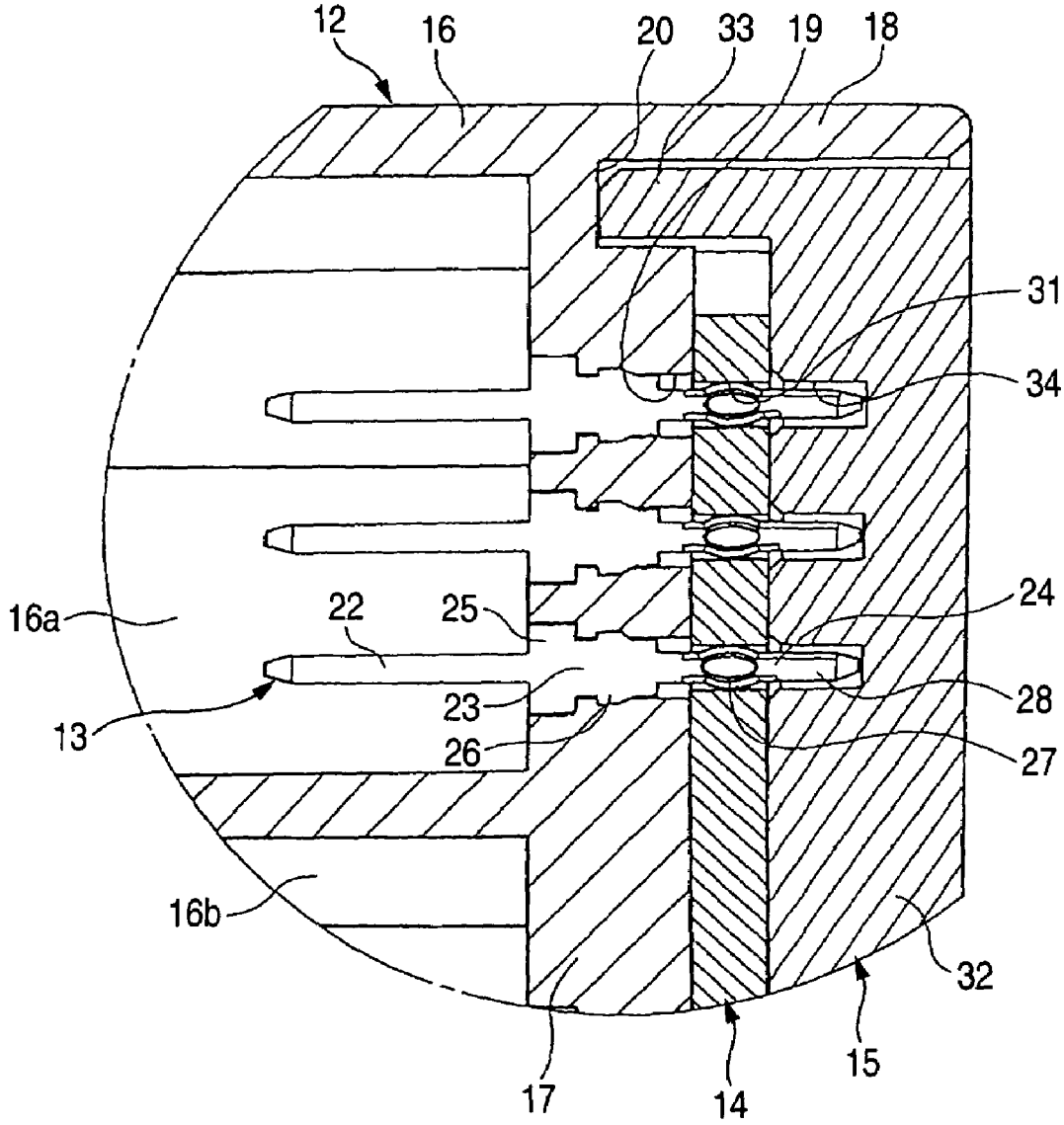
FIG. 4 is an enlarged cross-sectional view of an important portion of FIG. 3.
Figure 5:
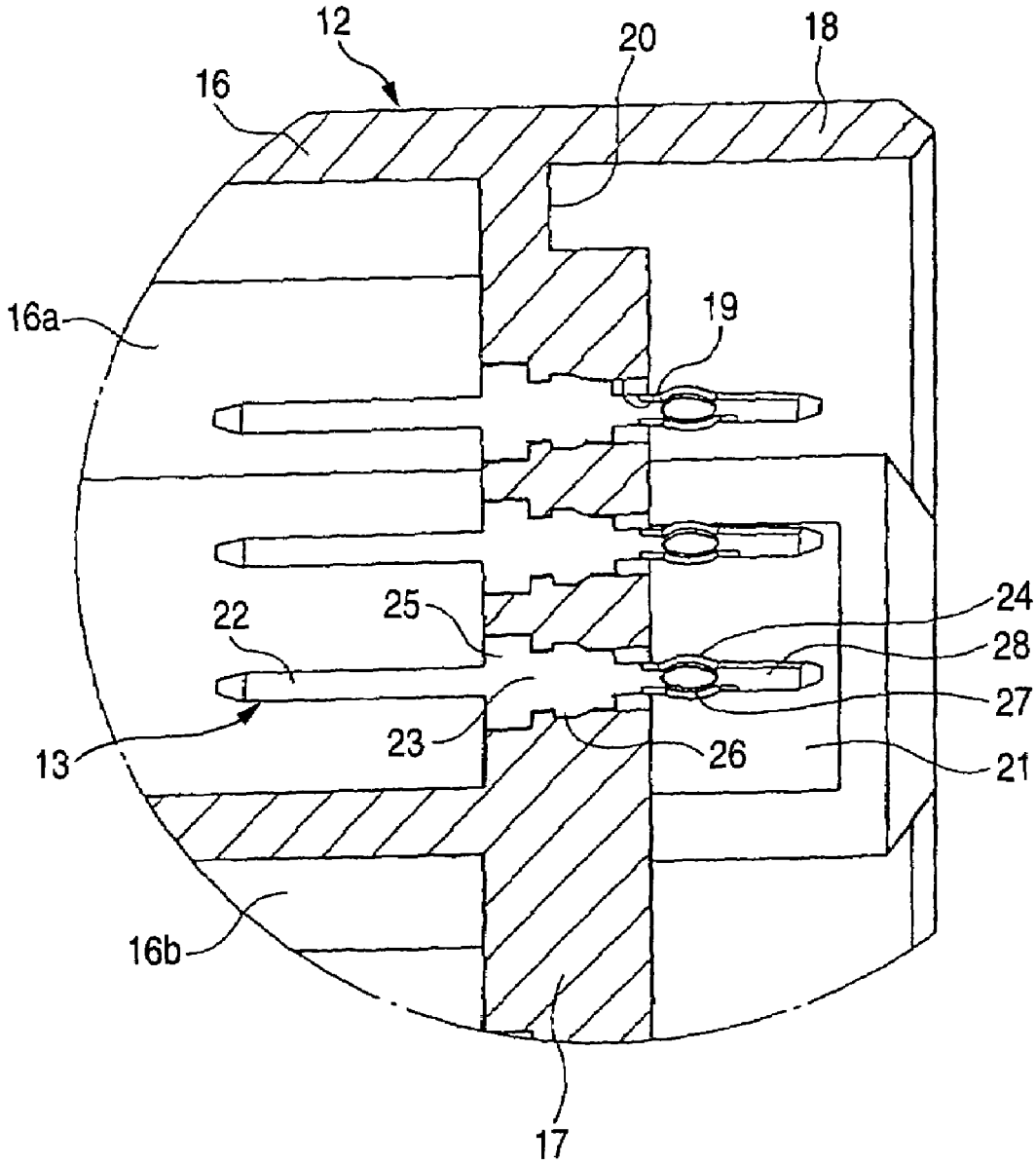
FIG. 5 is an enlarged cross-sectional view of an important portion, showing a condition in which connection terminals are fixed to a connector housing.
Figure 6:
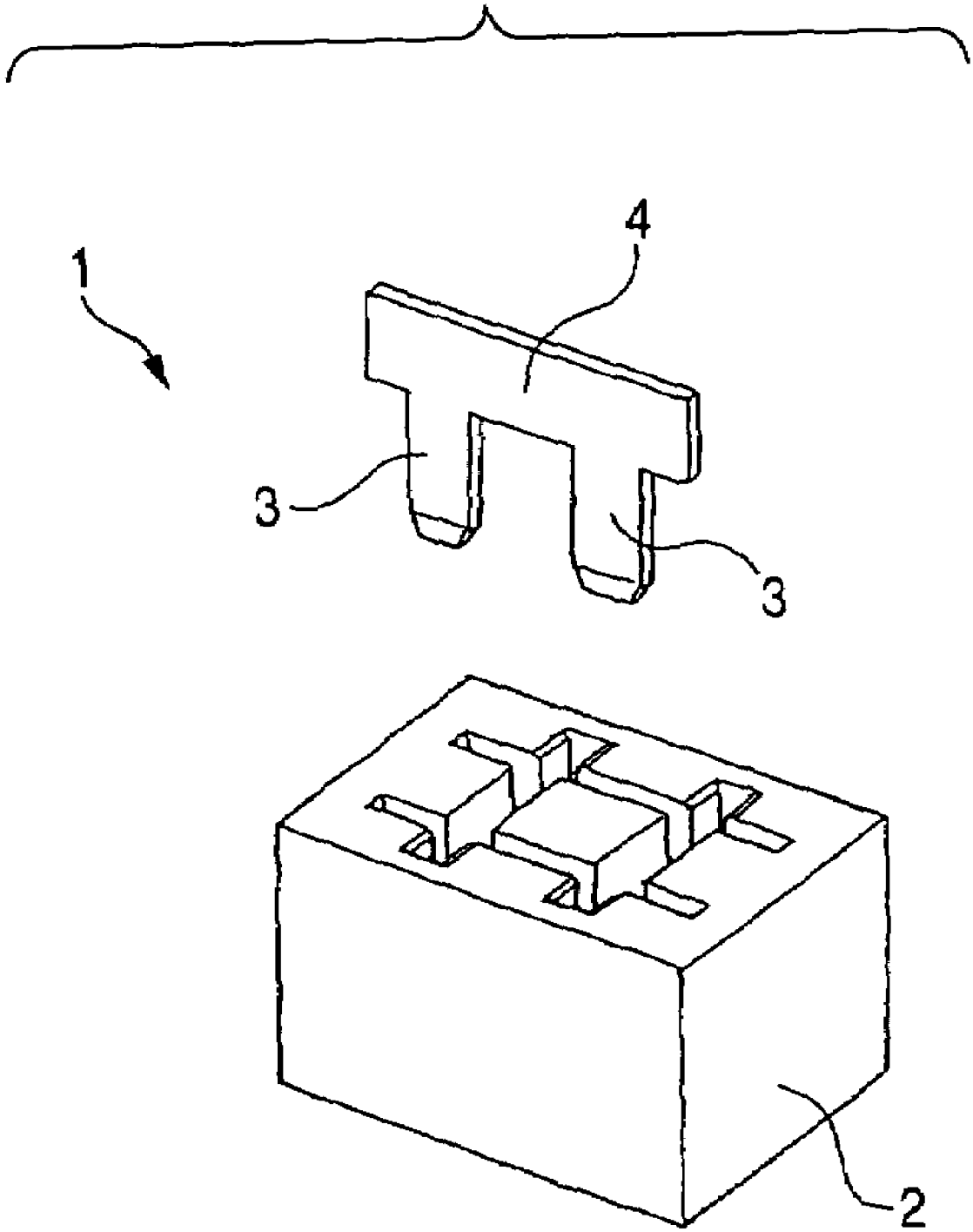
FIG. 6 is an exploded, perspective view of a related joint connector.
Figure 7:
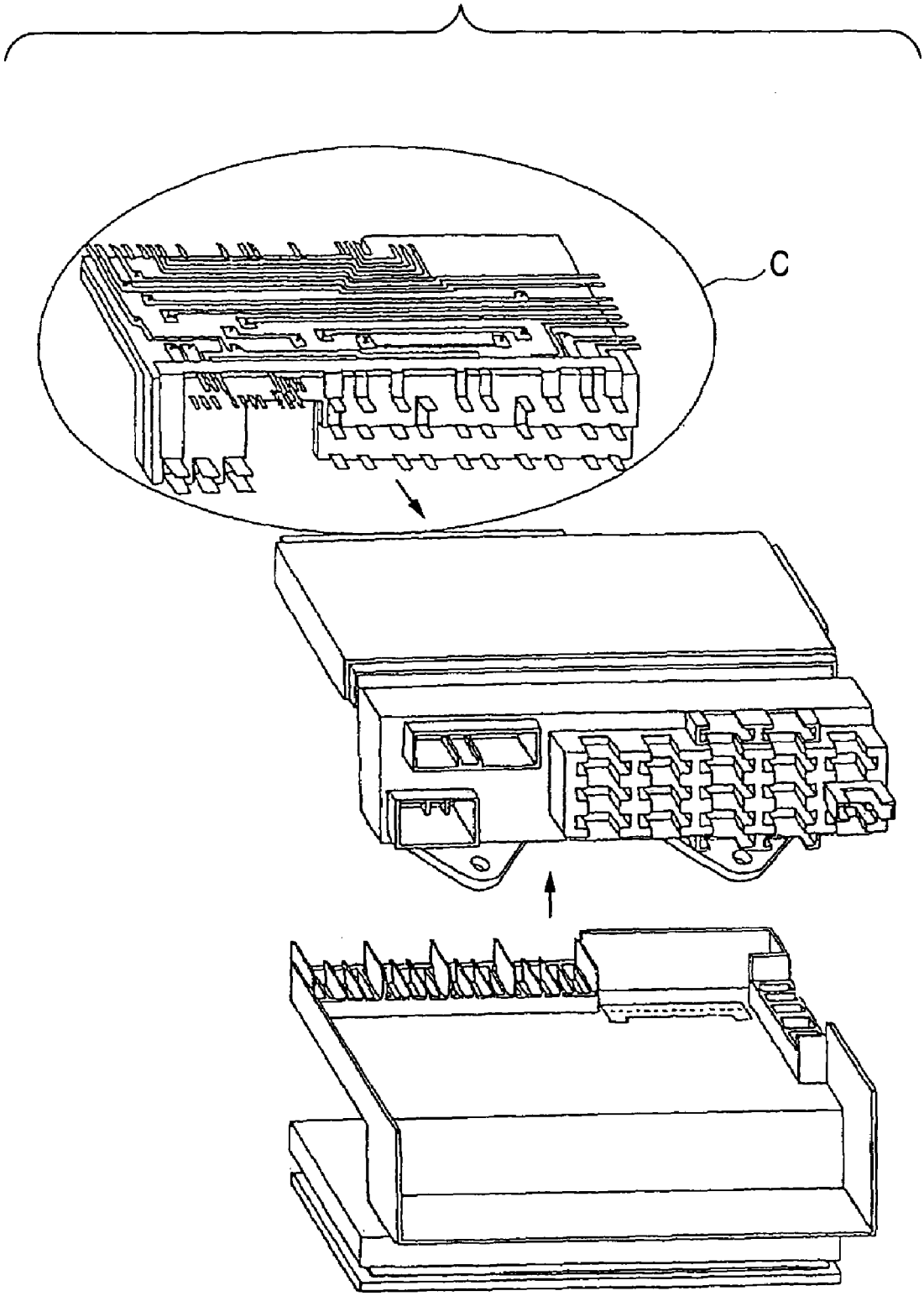
FIG. 7 is a view explanatory of a related joint technique employing bus bars and a board.

FIG. 1 is an exploded, perspective view of one preferred embodiment of a joint connector of the present invention. FIG. 2 is a perspective view of the joint connector, FIG. 3 is a cross-sectional view taken along the line III—III of FIG. 2, FIG. 4 is an enlarged cross-sectional view of an important portion of FIG. 3, and FIG. 5 is an enlarged cross-sectional view of an important portion, showing a condition in which connection terminals are fixed to a connector housing.

In FIGS. 1 to 5, reference numeral 11 denotes the joint connector of the invention. This joint connector 11 includes the connector housing 12, a plurality of connection terminals 13 for being fixed to the connector housing 12, a multi-layer board 14 in which the connection terminals 13 can be inserted, and a cover 15 for fitting to a rear side of the connector housing 12. The constructions of these parts will be described below in detail The connector housing 12 is molded of an insulative synthetic resin, and a fitting portion 16 into which connector housings of a plurality of mating connectors (not shown) can be fitted is formed in a front side of the connector housing 12. A terminal fixing portion 17 for the plurality of connection terminals 13 is formed within the connector housing 12, and is disposed intermediate the front and rear sides thereof. A board receiving portion 18 is formed at the rear side of the connector housing 12, and the multi-layer board 14 is received in the board receiving portion 18, and the cover 15 is fitted in this board receiving portion 18.

The fitting portion 16 is so shaped as to guide the connector housings of the mating connectors during the insertion of these connector housings and also to retain the inserted connector housings. The fitting portion 16, though not limited to such a construction, has three fitting portions (first to third fitting portions 16*a* to 16*c*).

The terminal fixing portion 17 is defined by an inner end wall disposed at the inner end of the fitting portion 16, and a plurality of through holes 19 for terminal press-fitting purposes are formed through the terminal fixing portion 17. The through holes 19 are formed through the terminal fixing portion 17, and extend perpendicularly to the front and rear sides of this terminal fixing portion 17. Each through hole 19 is formed into such a stepped shape that the connection terminal 13, when inserted into the through hole 19 from that side (i.e., the front side) of the terminal fixing portion 17 facing the terminal fixing portion 16, can be stopped at a predetermined position. In this embodiment, the number of the through holes 19 is as follows (This number is given merely as one example). Namely, 3×9 through holes 19 are formed through each of those portions of the terminal fixing portion 17 corresponding respectively to the first and second fixing portions 16*a* and 16*b*, while 11×9 through holes 19 are formed through that portion of the terminal fixing portion 17 corresponding to the third fitting portion 16*c*.

In this embodiment, although the connection terminals 13 are adapted to be press-fitted in the respective through holes 19 in the terminal fixing portion 17, and are fixed thereto, this embodiment is not limited to this construction, and the connection terminals can be fixed to the terminal fixing portion by insert molding.

The board receiving portion 18 is formed to be open to the rear side of the connector housing 12. The depth and size of the board receiving portion 18 are determined in view of the thicknesses of the multi-layer board 14 and cover 15. A recess 20 for the insertion of a front end portion of the cover 15 thereinto is formed in the board receiving portion 18, and also retaining portions 21 with which retaining projections 35 (described later) of the cover 15 can be retainingly engaged, respectively, are formed at the board receiving portion 18.

Each of the connection terminals 13 is formed of an electrically-conductive metallic material. The connection terminal 13 includes a connector-contacting portion 22, a fixing portion 23, and a press-fit portion 24. The connection terminal 13 is formed, for example, into a generally pin-like shape. The connection terminal 13 may be called a press-fit terminal since it has the press-fit portion 24.

When the connection terminal 13 is fixed to the connector housing 12, the connector-contacting portion 22 projects into the fitting portion 16, and contacts a connection terminal of the mating connector. In this embodiment, although the connector-contacting portion 22 is formed into a pin-like shape, it is not limited to this shape, but can be formed into a tab-like shape.

The fixing portion 23 is formed at a middle portion of the connection terminal 13. When the connection terminal 13 is fixed to the connector housing 12, the fixing portion 23 is press-fitted in the through hole 19 in the terminal fixing portion 17. The fixing portion 23 includes an abutment portion 25 for abutting against the stepped portion of the through hole 19, and a withdrawal prevention portion 26 for biting into the inner surface of the through hole 19. The abutment portion 25 is disposed close to the connector-contacting portion 22, while the withdrawal prevention portion 26 is disposed close to the press-fit portion 24.

When the connection terminal 13 is fixed to the connector housing 12, the press-fit portion 24 projects into the board receiving portion 18 to be inserted into the multi-layer board 14. The press-fit portion 24 includes a resiliently-deformable body portion 27 (having, for example, a generally oval shape) disposed close to the fixing portion 23, and a pin-like guide portion 28 which extends continuously from the body portion 27, and is disposed at the distal end portion.

The multi-layer board 14 is a member comprising a plurality of boards 29 laminated together, and this multi-layer board is formed, for example, by four boards 29*a* to 29*d* although the number of the boards is not particularly limited to four. The boards 29 are fixed to one another by suitable fixing portion such as an adhesive or a fixing member. A plurality of circuits 30, having respective predetermined path patterns, are formed by printing on each board 29. The circuits 30 correspond to inter-terminal connecting portions, and in this embodiment the plurality of circuits 30 are formed by printing on that surface (front surface) of the board from which the connection terminals 13 are inserted into the board. Each board 29 is similar in construction to a known printed circuit board.

A plurality of through holes 31 are formed through each board 29 of the multi-layer board 14. The press-fit portions 24 of the connection terminals 13 are inserted into the through holes 31, and the number and arrangement of the through holes 31, formed in each board, correspond to the number and arrangement of the connection terminals 31, respectively. Each through hole 31 is formed into such a size that the body portion 27 of the press-fit portion 24, inserted into the through hole 31, can be resiliently deformed.

The through holes 31 are classified into through holes 31*a*, each having a circuit conducting portion (not shown) for electrically connecting the body portion 27 and the circuit 30 together, and through holes 31*b* each in the form of a mere through hole not provided with the circuit conducting portion (not shown). By suitably using these through holes, desired connection terminals 13 can be electrically connected together. Each of the through holes 31*a* has the circuit conducting portion (not shown), and therefore is formed through that portion of the board 29 at which the corresponding circuit 30 is formed. On the other hand, the through holes 31*b* do not have the circuit conducting portion (not shown), and therefore are formed through those portions of the board 29 at which any circuit 30 is not formed.

Instead of using the multi-layer board 14, there can be used a single board. Although not particularly shown in the drawings, the single board is one printed circuit board, and is larger in thickness than the board 29, and circuits, having respective predetermined path patterns, are formed by printing on front and rear surfaces thereof. The single board is effectively used when it is smaller in the number of circuits than the multi-layer board 14.

The cover 15 is a member which is inserted into the board receiving portion 18 of the connector housing 12, and is retained there. This cover 15 includes a bottom portion 32, and a side portion 33, and is formed into a box-like shape with a shallow bottom. The bottom portion 32 of the cover 15 is in the form of a flat plate, and a plurality of recesses 34 are formed in that side (or surface) of the bottom portion 32 facing the multi-layer board 14, and the press-fit portions 24 of the connection terminals 13, projecting through the multi-layer board 14, are inserted into the recesses 34, respectively. The recesses 34, formed in the bottom portion, correspond in the number and arrangement to the connection terminals 13.

The plurality of retaining projections 35 for retaining engagement respectively with the retaining portions 21 on the connector housing 12 are formed at the side portion 33 of the cover 15. The retaining projection 35 is formed into a claw-like shape. Further, a tapering surface is formed on the retaining projection 35 so as to achieve the smooth engagement.

The provision of the cover 15 is arbitrary. When the cover is provided as in this embodiment, the cover effectively protects and retains the multi-layer board 14.

In the above construction, the connection terminals 13 are inserted or press-fitted respectively into the through holes 19 in the terminal fixing portion 17 of the connector housing 12, and are fixed thereto, and the press-fit portions 24 of the connection terminals 13 are projected into the board receiving portion 18 of the connector housing 12, and the multi-layer board 14 is attached to the connector housing 12 in such a manner that the press-fit portions 24 are inserted respectively into the corresponding through holes 31. Thereafter, the cover 15 is fitted in the connector housing 12, and is retained thereto in such a manner that this cover 15 covers the multi-layer board 14 received in the board receiving portion 18, thereby forming the joint connector 11 of the invention.

When the mating connectors are connected to the fitting portion 16 of the joint connector 11 of the invention, a plurality of branch wire portions are obtained, for example, from one trunk wire portion of a wire harness.

As described above with reference to FIGS. 1 to 5, the joint connector 11 of the invention employs the multi-layer board 14 (or the above single board) formed by laminating the plurality of boards (printed circuit boards) 29 together, and therefore this joint connector can be formed into a more compact design than the related joint connector, and also the degree of freedom of the circuitry design can be enhanced (that is, is higher as compared with the structure in which joint connections are made by installing bus bars or wires).

And besides, in the joint connector 11 of the invention, bus bars as used in the related construction are not used, and instead the multi-layer board 14 (or the above single board) having the circuits 30 formed thereon by printing, are used. Therefore, this joint connector can be formed into a more lightweight and lower-cost design than the related joint connector, and also the management of the parts as a whole can be simplified.

Furthermore, the joint connector 11 of the invention is of such a structure that desired connection terminals 13 can be collectively joint-connected simultaneously when the multi-layer board 14 (or the above single board) is attached to the connector housing, and therefore the assembling operation can be effected easily.

And besides, the invention can be modified in various ways within the scope of the invention, that is, without departing from the subject matter of the invention.

What is claimed is:

1. A joint connector, comprising:

an insulative connector housing including a board receiving portion;

a plurality of connection terminals, provided on the connector housing, which include projecting portions that project into the board receiving portion; and a board, which is inserted into the board receiving portion of the connector housing, on which a conductive wire and a plurality of through holes that provide electrical connections to the conductive wire are formed, wherein the projecting portions of the connection terminals contact to the conductive wire at the through holes of the board that is inserted into the board receiving portion of the connector housing to electrically connect predetermined connection terminals of the connection terminals with each other;

wherein the board is a multi-layer board having a plurality of board portions which are laminated to each other;

wherein a plurality of the conductive wires are respectively formed on the board portions; and wherein the connection terminals contact to the conductive wire formed on a predetermined board portion of the board portions.

2. The joint connector as set forth in claim 1, wherein a circuit, which is connected to the conductive wire, is formed on the board.

3. The joint connector as set forth in claim 1, wherein the connector housing includes a mating terminal portion in which connector contacting portions of the connection terminals, which are provided on ends of the connection terminals opposed to the projecting portions in the board receiving portion, project into the mating terminal portion for mating with another terminal to be electrically connected to the connection terminals.

4. The joint connector as set forth in claim 1, further comprising a cover, fitted to the connector housing to cover the board receiving portion of the connector housing and the board inserted therein.

5. The joint connector as set forth in claim 1, wherein the board is detachably retained in the board receiving portion of the connector housing by the connector pins that are inserted into the through holes of the board.

6. The joint connector as set forth in claim 1, wherein the projecting portions of the connection terminal include press-fit portion that resiliently deform when inserted into the through holes of the board.

7. A joint connector, comprising:

an insulative connector housing including a board receiving portion;

a plurality of connection terminals, provided on the connector housing, which include projecting portions that project into the board receiving portion; and a board, which is inserted into the board receiving portion of the connector housing, on which a conductive wire and a plurality of through holes that provide electrical connections to the conductive wire are formed, wherein the projecting portions of the connection terminals contact to the conductive wire at the through holes of the board that is inserted into the board receiving portion of the connector housing for electrically connecting predetermined connection terminals of the connection terminals with each other, wherein the board is a single-layer board having a front face and rear face;

wherein a plurality of the conductive wires are respectively formed on the front and rear faces of the single-layer board; and wherein the connection terminals contact to the conductive wire formed on at least one of the front and rear faces of the single-layer board.

8. The joint connector as set forth in claim 7, wherein a circuit, which is connected to the conductive wire, is formed on the board.

9. The joint connector as set forth in claim 7, wherein the connector housing includes a mating terminal portion in which connector contacting portions of the connection terminals, which are provided on ends of the connection terminals opposed to the projecting portions in the board receiving portion, project into the mating terminal portion for mating with another terminal to be electrically connected to the connection terminals.

10. The joint connector as set forth in claim 7, further comprising a cover, fitted to the connector housing to cover the board receiving portion of the connector housing and the board inserted therein.

11. The joint connector as set forth in claim 7, wherein the board is detachably retained in the board receiving portion of the connector housing by the connector pins that are inserted into the through holes of the board.

12. The joint connector as set forth in claim 7, wherein the projecting portions of the connection terminal include press-fit portion that resiliently deform when inserted into the through holes of the board.

* * * * *